US007415122B2

(12) United States Patent
Soutar et al.

(10) Patent No.: US 7,415,122 B2
(45) **Date of Patent: *Aug. 19, 2008**

(54) MICROPHONE SHIELD SYSTEM

(75) Inventors: Ian Soutar, Victoria (CA); Dennis Watkins, Brentwood Bay (CA); William Copeland, Victoria (CA)

(73) Assignee: QNX Software Systems (Wavemakers), Inc. (CA)

( * ) Notice: Subject to any disclaimer, the term of this patent is extended or adjusted under 35 U.S.C. 154(b) by 416 days.

This patent is subject to a terminal disclaimer.

(21) Appl. No.: 10/902,961

(22) Filed: Jul. 30, 2004

(65) Prior Publication Data

US 2005/0063560 A1 Mar. 24, 2005

Related U.S. Application Data

(63) Continuation-in-part of application No. 09/579,119, filed on May 25, 2000, now Pat. No. 6,771,788.

(51) Int. Cl.
*H04R 25/00* (2006.01)

(52) U.S. Cl. ..... 381/189; 381/355; 381/369

(58) Field of Classification Search ..... 381/189, 381/334–347, 355, 360–361, 369; 128/19, 128/201; 181/149; 367/141, 174
See application file for complete search history.

(56) References Cited

U.S. PATENT DOCUMENTS

| | | | | |
|---|---|---|---|---|
| 1,901,065 A | | 3/1933 | Spotts | |
| 2,556,168 A | | 6/1951 | Cragg et al. | |
| 3,588,382 A | | 6/1971 | Reedyk | |
| 4,123,622 A | | 10/1978 | MacLeod | |
| 4,845,760 A | * | 7/1989 | Awakowicz et al. | 381/189 |
| 4,887,300 A | | 12/1989 | Erling | |
| 4,975,966 A | | 12/1990 | Sapiejewski | |
| 5,808,243 A | | 9/1998 | McCormick et al. | |
| 6,018,585 A | | 1/2000 | Akino et al. | |
| 6,188,773 B1 | | 2/2001 | Murata et al. | |

FOREIGN PATENT DOCUMENTS

| | | |
|---|---|---|
| EP | 1 113 701 A2 | 7/2001 |
| GB | 2 234 137 A | 1/1991 |
| JP | 61-168279 | 5/1988 |
| JP | HEI 10-98791 | 4/1998 |
| JP | 2001-313990 | 11/2001 |
| WO | WO 97/20449 A | 6/1997 |

* cited by examiner

*Primary Examiner*—Suhan Ni
(74) *Attorney, Agent, or Firm*—Brinks Hofer Gilson & Lione

(57) ABSTRACT

A microphone shield system captures sound in adverse conditions. The system includes a microphone positioned within an enclosure. A membrane stretched across a portion of the enclosure passes signals within a selected frequency range. The membrane may block or attenuate signals above and/or below the frequency range to pass a desired sound with little surrounding interference.

23 Claims, 5 Drawing Sheets

MICROPHONE SHIELD SYSTEM

PRIORITY CLAIM

This application is a continuation-in-part of U.S. application Ser. No. 09/579,119, originally titled "Shielding A Microphone From Environmental Effects," filed May 25, 2000, now U.S. Pat. No. 6,771,788. The disclosure of the above application is incorporated herein by reference.

BACKGROUND OF THE INVENTION

1. Technical Field

This invention relates to a microphone shield, and more particularly, to a system that protects a microphone against environmental conditions.

2. Related Art

Television, movie, and wireless communication industries rely on instruments to convert voice and other sounds into signals that may be transmitted to other locations and reconverted into high quality sound. High quality sound may be important for meeting consumer expectations and for accurately preserving events. Obtaining high-quality sound can be very difficult, particularly when the sound is affected by ambient noise.

Many sources create ambient noise. Frequently encountered sources include wind and rain. Wind may distort the sound detected by microphone sensing elements, while rain may create noise as it strikes the sensing elements. Electronic filtering has been used to remove some wind and rain noises. However, electronic filtering may attenuate some audio frequencies which may degrade sound clarity and quality.

Therefore a need exists for a shield that overcomes some of these potential problems in the related art.

SUMMARY

This invention provides a shield system that captures selected sound. The shield system includes a microphone enclosure coupled to a neck extension. A membrane stretched across a portion of the enclosure passes signals within a selected frequency range. The membrane may block or attenuate signals above and/or below the frequency range to capture the selected sound.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
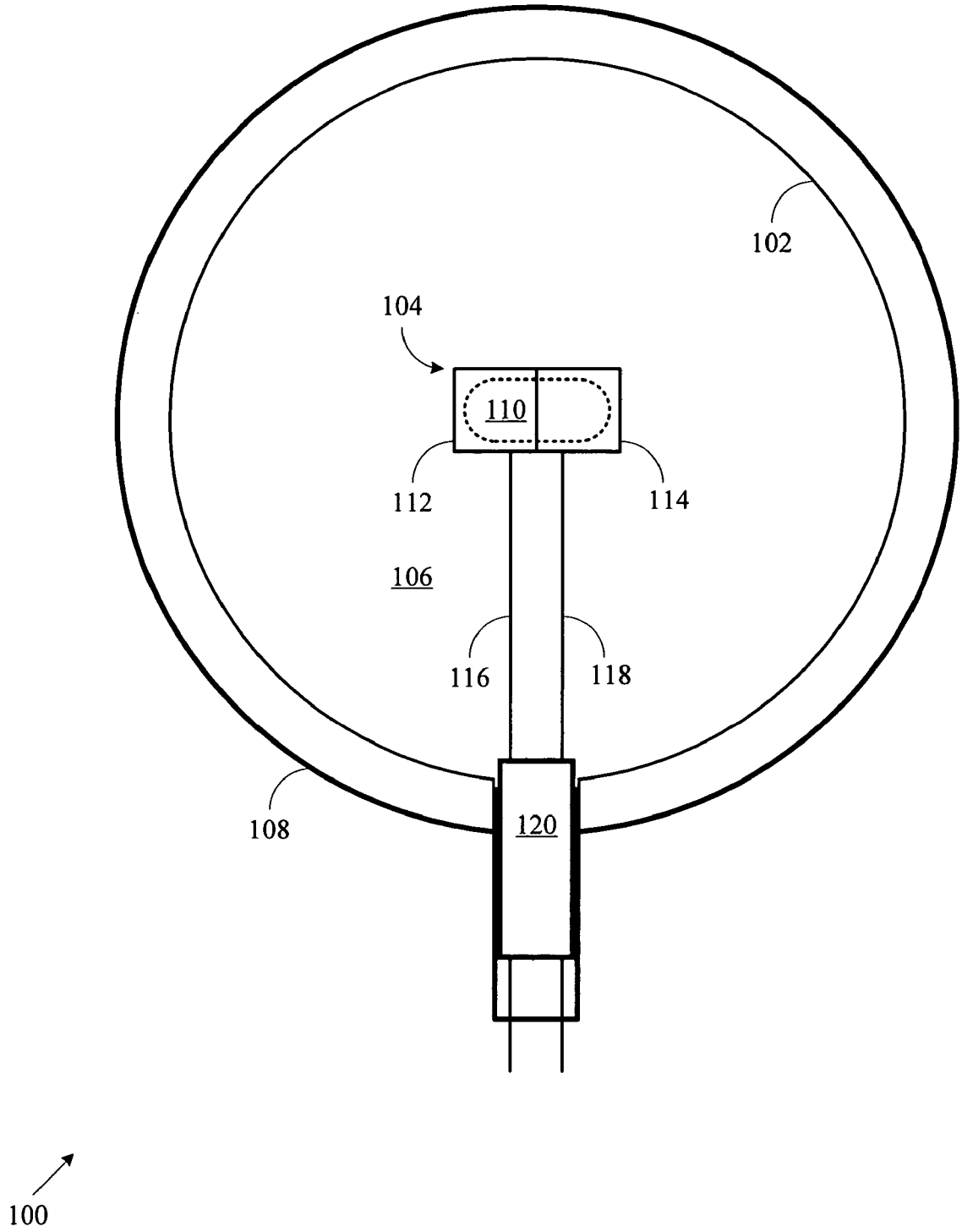
FIG. 1 shows a microphone shield system.

In FIG. 1, a microphone shield system 100 may include an elastic membrane 102 that surrounds a microphone 104. The membrane 102 may form an enclosure 106. The system 100 also may include a foam layer 108 that surrounds all or part of the membrane 102.

The microphone 104 may include a sensing element 110 having a front surface 112 and a back surface 114. Signal connectors 116 and 118 positioned between the front and back surfaces 112 and 114 may pass through the enclosure 106. A seal 120 may prevent the passage of liquid or gas into or out of the enclosure.

The membrane 102 may be several mils thick. The membrane 102 may be made of synthetic rubber, such as the rubber found in an inflatable balloon, may be made of latex, or may be made from other materials. The membrane 102 may be impermeable and elastic and may be inflated to surround the microphone 104.

The membrane 102 may be inflated to several PSI (e.g., 1-3 PSI) above an atmospheric pressure. The membrane 102 also may be inflated above an expected pressure exerted by a turbulence, a wind, a rain or other environmental force on the enclosure 106. The inflation pressure may substantially match or exceed a selected or expected pressure. The pressure may be a continuous or varying pressure that may strike the membrane.

Any medium that may expand and contract with changes in pressure and that may readily occupy the enclosure 106 may be used to inflate the membrane 102. The medium may comprise a liquid or a gas. When gas is employed, the gas may have a relatively large molecular size in comparison to the permeability of the membrane 102. The gas may be carbon dioxide, or a combination of gases such as air or other gases. When gases with relatively large molecular sizes are employed to inflate the membrane 102, the membrane may remain inflated for an extended period of time.

The foam layer 108 may be an open cell foam, such as a plastic open cell foam. The foam layer 108 also may have a natural foam structure such as that found in an organic sponge. Combinations of foam materials also may be employed.

The foam layer 108 may be made to a variety of thicknesses. The foam layer 108 may be less than about 0.25" thick, may be about 0.25"— about 0.5" thick, or may be made to other thicknesses or range of thicknesses. As the foam layer 108 increases in thickness, the foam layer 108 may increasingly block turbulence and also may attenuate higher frequency interference from an incoming signal before it reaches the membrane 102. The foam layer 108 may be mechanically retained above or in contact with the membrane 102 or may be stretched across the membrane 102.

Sound waves that strike the membrane 102 may cause the membrane 102 to vibrate and transmit energy through the medium within the enclosure 106. The inflation pressure may dampen or absorb turbulence, may reduce pressure variations across the microphone 104, and may filter out undesired noise. The membrane 102 may also act as a bandpass filter by passing signals within certain frequency bands, and blocking or attenuating signals above and/or below the band.

The membrane 102 may be selected to create a pass band of about 100 Hz to about 10 KHz., about 300 Hz to about 5 KHz, about 100 Hz to about 15-25 KHz, about 300 Hz to about 3,400 Hz, or other frequency ranges. Combinations of pass bands also may be employed. A pass band of about 100 Hz to about 10 KHz may be employed when the microphone captures music signals. A pass band of about 300 Hz to about 5 KHz or about 300 Hz to 3,400 Hz may be employed when the microphone captures voice signals such as speech or singing. A pass band of about 100 Hz to about 15-25 KHz may be employed when the microphone captures high fidelity music.

The frequency range passed by the membrane 102 may be adjusted by manipulating the foam layer 108. Changes in the foam material, its elasticity, and its thickness may change the pass band characteristics. Similarly, changes in the membrane material, inflation pressure, thickness, and thickness range may also change the pass band characteristics.

The membrane 102 may be made thicker to reduce the frequency range of the pass band or to cause the pass band to shift down in frequency. Alternatively, the membrane 102 may be under inflated to reduce the frequency range of the pass band or to cause the pass band to shift down in frequency. The membrane 102 and the foam layer 108 may reduce pressure differences, including sub sonic variations in air pressure, in the enclosure 106 and between the front 112 and back 114 of the microphone sensing element 110.

To prevent the escape of the enclosed medium and to protect against environmental effects, the enclosure 106 may be sealed. The seal 120 may be a rubber stopper, a clamp, a tie, an adhesive seal, or another device or seal that substantially prevents leakage. The signal connectors 116 and 118 may pass through the seal 120, or may be guided out of the enclosure 106 through another opening. An inflation needle may pass between the seal 120 and the membrane 102 or may pass through the seal 120 to inflate the membrane 102.

The microphone 104 converts sound into electrical or optical signals. Additional hardware and/or software may convert the microphone output into digital data that a computer or a controller may process. Wires may connect the output of the microphone to a destination. Alternatively, the connection may be wireless and may use a modulated carrier, such as a frequency or amplitude modulated connection. A hardwire or wireless connection may link the microphone to a wireless network such as a ZigBee, Mobile-Fi, Ultrawideband, Wi-fi, or a WiMax network.

Figure 2:
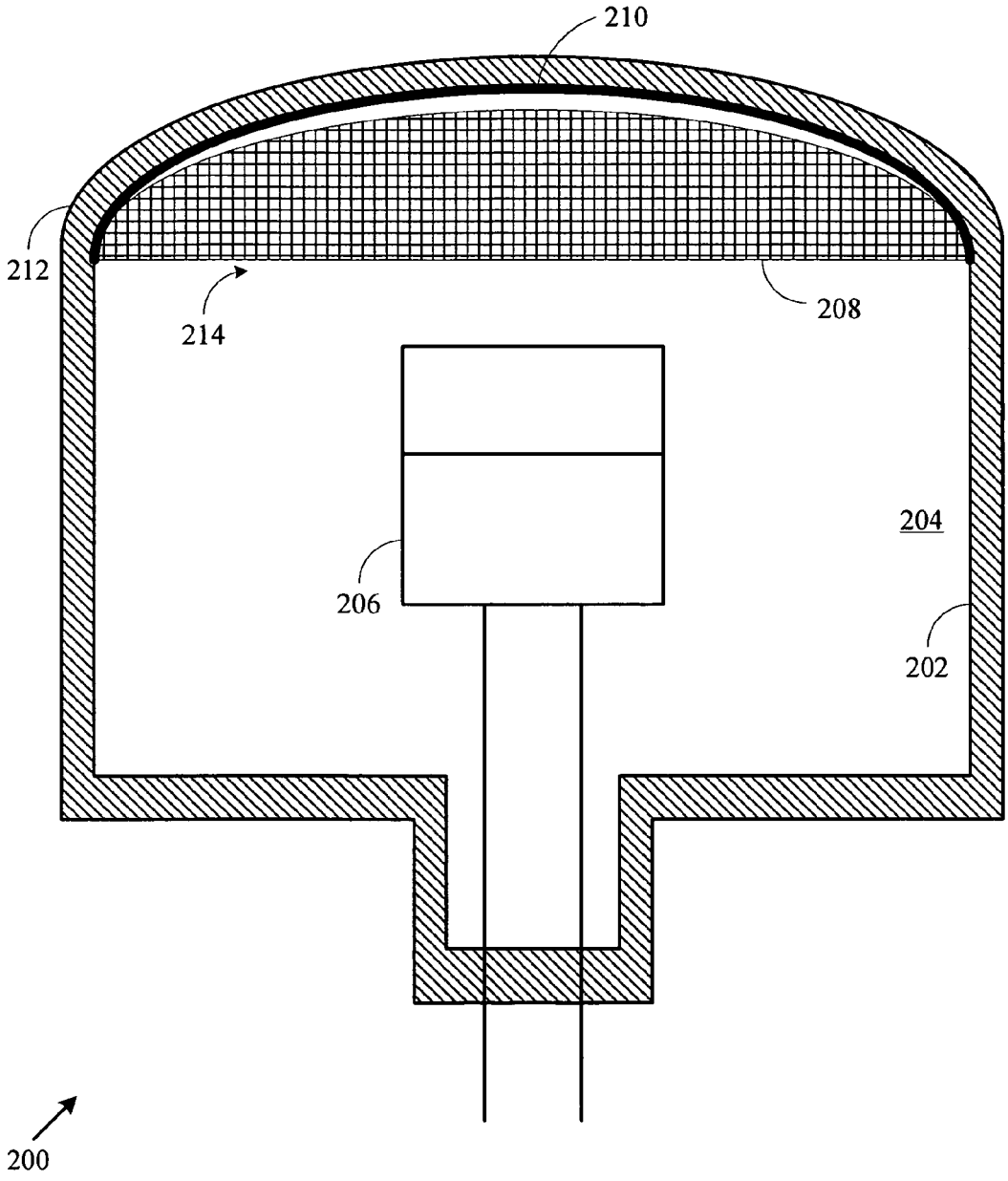
FIG. 2 shows a second microphone shield system.

In FIG. 2, a microphone shielding system 200 may include a microphone enclosure 202 that forms a chamber 204. The chamber 204 may surround a microphone 206. The shielding system 200 may also include a membrane support 208, a membrane 210, and a foam layer 212. The microphone enclosure 202 may have an opening 214 positioned above the microphone to receive sound waves.

The membrane support 208 may extend across all or part of the opening 214 with the foam layer 212 covering all or part of the membrane 210. The membrane support 208 may be made of wire mesh. The membrane 210 also may cover all or part of the microphone enclosure 202. The microphone enclosure 202 may be a rigid air tight enclosure that protects the microphone 206 against wind, rain, and other environmental effects.

The membrane support 208 may form a dome over the chamber 204 or may extend across the chamber 204 without a curved surface. The membrane 210 may be mechanically stretched across the membrane support 208 to tighten or fasten the membrane 210 to the enclosure. The membrane support 208 may limit the deformation of the membrane 210 under any type of external conditions, such as high winds or heavy rains.

Figure 3:
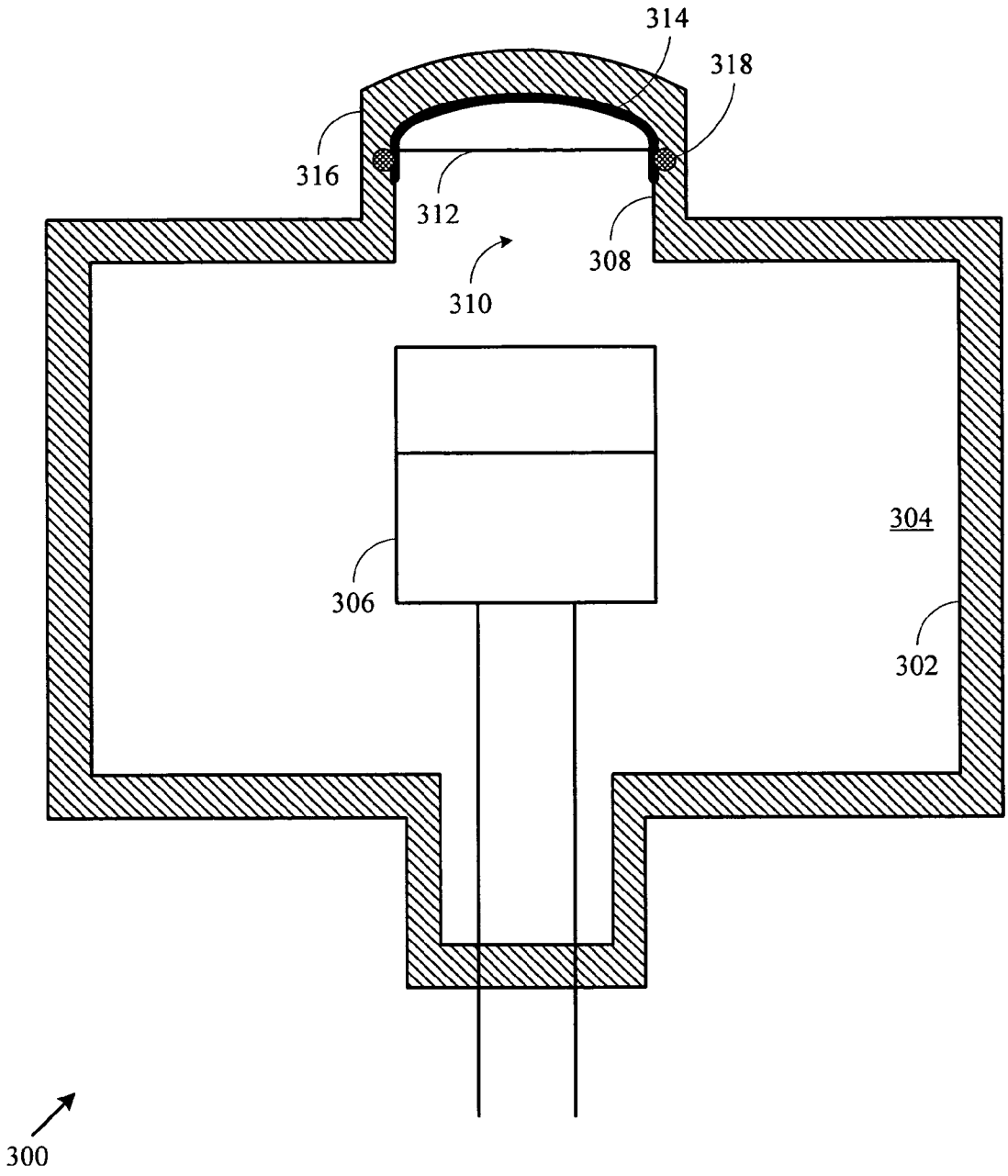
FIG. 3 shows a third microphone shield system.

In FIG. 3, a microphone shielding system 300 may include a microphone enclosure 302 that forms a chamber 304. The chamber 304 may include a neck 308. The neck 308 may form an extension to the microphone enclosure 302 and may have an opening 310 smaller in width than the width of chamber 304. The opening 310 may facilitate stretching or fastening of the membrane 314 across the opening 310. A foam layer 316 may extend over all or part of the opening 310 and microphone enclosure 302.

The neck 308 may be a unitary part of the enclosure 302 and may be formed by a molding process. The neck 308 also may be separately attached to or functionally couple to the enclosure 302. Furthermore, the neck 308 may protrude from a side of the enclosure 302, rather than the end shown in FIG. 3.

A fastener 318 may attach the membrane 314 to the enclosure 302 or the neck 308 above the membrane support 312. The fastener 318 may be a flat ring made of plastic or rubber and may be employed as a gasket. The fastener 318 may be pressed over the membrane 314 and the neck 308 to attach the membrane to the microphone enclosure 302.

Figure 4:
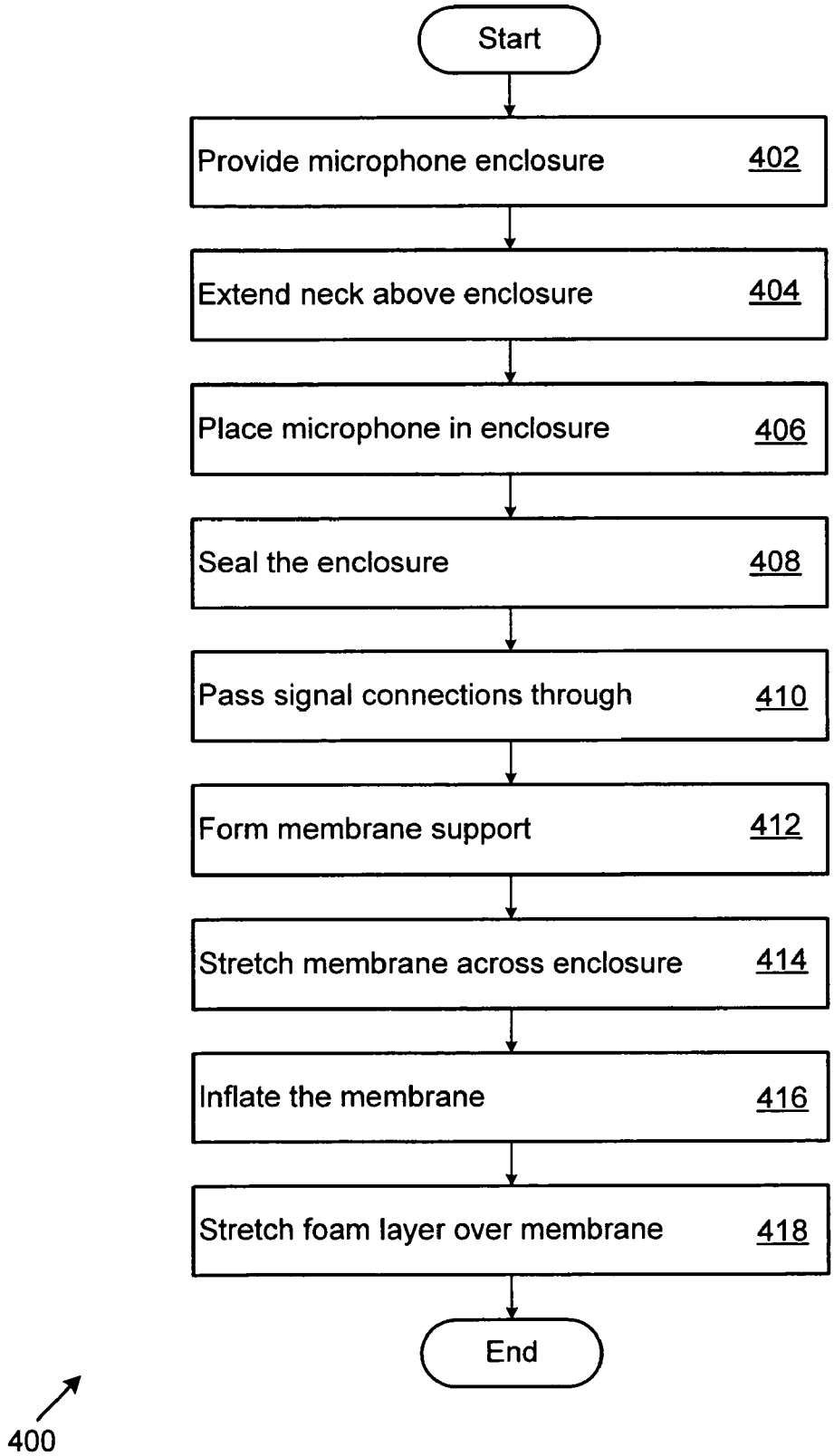
FIG. 4 is a flow diagram for making a microphone shield system.

FIG. 4 is a flow diagram 400 for making a microphone shield system. A microphone enclosure may form a microphone chamber (Act 402). A neck may be extended above the microphone enclosure to form a second chamber having an opening smaller in width than the microphone enclosure (Act 404).

A microphone may be placed within the chamber so that it is surrounded or enclosed by the walls of the chamber (Act 406). The chamber may be sealed by a stopper, a clamp, a tie, or by applying an adhesive or sealant such as glue or cement to the enclosure (Act 408). Signal connectors coupled to the microphone may pass through openings or through a chamber seal (Act 410).

A membrane support may be formed above the chamber (Act 412). A wire mesh or other support structures positioned across all or part of the opening formed within the chamber may be employed. A membrane may be stretched across the microphone enclosure and the membrane support (Act 414). The membrane may be an elastic membrane and may be stretched by an inflation, a mechanical method, or a combination of methods.

The chamber may be pressurized above an atmospheric pressure (Act 416). The membrane may be inflated by a gas, liquid, or other substance. A foam layer may be stretched across, and optionally placed in contact with, the membrane (Act 418). The foam layer may be an artificial open cell foam, a natural foam, or a combination of foams. The foam layer thickness may be adjusted to create a bandpass filter with a desired frequency response.

Figure 5:
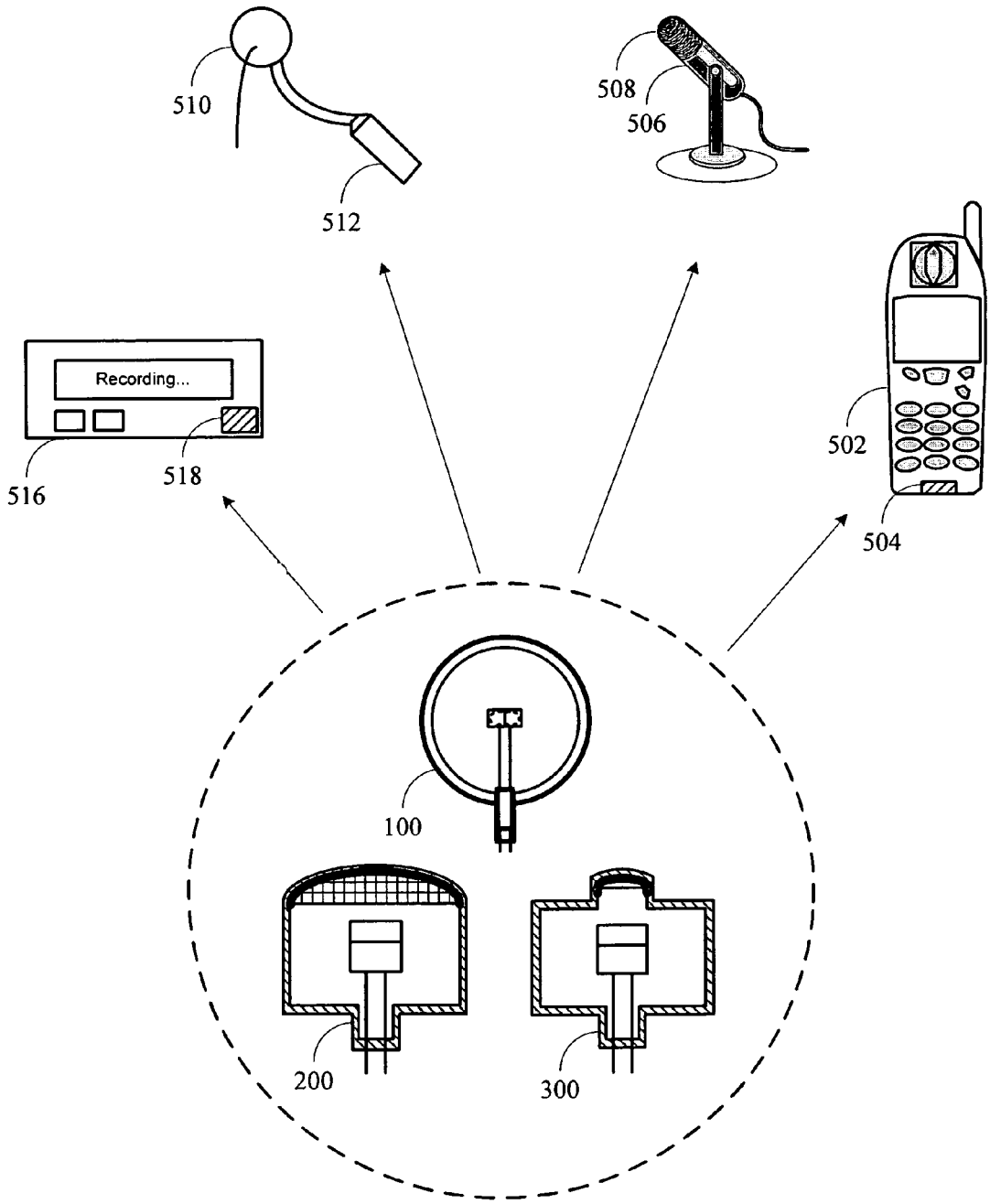
FIG. 5 shows systems that may incorporate a microphone shield system.

FIG. 5 shows systems that may incorporate the shield systems 100, 200, or 300. A phone, such as the cell phone 502, may include a shield system 504. The shield system 504 in the cell phone 502 may provide a frequency response of about 300 Hz to about 5 KHz or about 300 Hz to 3,400 Hz or any other desired frequency response.

The microphone system 506 also may include a shield system 508. The microphone system 506 may be a hardwired or wireless microphone. The shield system 508 may be adjusted to provide a frequency response of about 100 Hz to about 10 KHz for capturing music signals, about 100 Hz to about 15-25 KHz for capturing high fidelity music, or about 300 Hz to about 3,400 Hz or about 5 KHz for capturing speech.

A headset microphone system 510, such as that used in an office, may also employ a shield system 512. The shield system 512 may be adjusted to provide a frequency response that passes voiced signals.

FIG. 5 also shows a voice recorder 516. The voice recorder may be portable, and may record or process MP3 or WAV files. In the voice recorder 516, a shield system 518 may provide a frequency response that passes voiced and unvoiced signals. Other systems that sense sound may also include one or more microphone shields.

The microphone shielding systems provide high-quality sound reproduction for many applications. The microphone shield systems may protect a microphone from rain, wind, and other environmental effects.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A microphone shield system comprising:

a microphone enclosure;

an enclosure neck extending from the microphone enclosure;

a membrane stretched across the enclosure neck; and a membrane support positioned across the enclosure neck.

2. The microphone shield system of claim 1, where the membrane is stretched by an inflated pressure, where the inflated pressure exceeds an atmospheric pressure.

3. The microphone shield system of claim 1, the membrane comprising a mechanically stretched membrane.

4. The microphone shield system of claim 1, the membrane comprising a mechanically stretched membrane inflated above atmospheric pressure.

5. The microphone shield system of claim 1, where the membrane support comprises a wire mesh support.

6. The microphone shield system of claim 1, where the membrane passes about 100 Hz to about 10 KHz.

7. The microphone shield system of claim 1, where the membrane passes about 300 Hz to about 5 KHz.

8. The microphone shield system of claim 1, further comprising a foam layer positioned above the membrane.

9. The microphone shield system of claim 1, further comprising a fastener coupled to the membrane that attaches the membrane to the microphone enclosure above the membrane support.

10. A microphone shield system comprising:

a microphone enclosure;

an enclosure neck extending from the microphone enclosure; and a membrane stretched across the enclosure neck by an inflated pressure, where the inflated pressure exceeds an atmospheric pressure.

11. The microphone shield system of claim 10, further comprising a membrane support positioned across the enclosure neck.

12. The microphone shield system of claim 11, the membrane support comprising a wire mesh support.

13. The microphone shield system of claim 10, where the membrane passes about 100 Hz to about 10 KHz.

14. The microphone shield system of claim 10, where the membrane passes about 300 Hz to about 5 KHz.

15. The microphone shield system of claim 10, further comprising a foam layer positioned above the membrane.

16. The microphone shield system of claim 10, where the inflated pressure is greater than or equal to an expected environmental pressure.

17. A microphone shield system comprising:

a microphone enclosure;

an enclosure neck extending from the microphone enclosure; and a membrane stretched across the enclosure neck, the membrane comprising a mechanically stretched membrane inflated above atmospheric pressure.

18. The microphone shield system of claim 17, further comprising a membrane support positioned across the enclosure neck.

19. The microphone shield system of claim 18, where the membrane support comprises a wire mesh support.

20. The microphone shield system of claim 17, where the membrane passes about 100 Hz to about 10 KHz.

21. The microphone shield system of claim 17, where the membrane passes about 300 Hz to about 5 KHz.

22. The microphone shield system of claim 17, further comprising a foam layer positioned above the membrane.

23. The microphone shield system of claim 17, where the mechanically stretched membrane is inflated above an expected environmental pressure.

* * * * *